US011280235B2

(12) United States Patent
Chang

(10) Patent No.: US 11,280,235 B2
(45) Date of Patent: Mar. 22, 2022

(54) MUFFLER STRUCTURE

(71) Applicant: Guang Rong Enterprise Co., Ltd., Yuanlin (TW)

(72) Inventor: Hao-Yao Chang, Yuanlin (TW)

(73) Assignee: Guang Rong Enterprise Co., Ltd., Yuanlin (TW)

( * ) Notice: Subject to any disclaimer, the term of this patent is extended or adjusted under 35 U.S.C. 154(b) by 226 days.

(21) Appl. No.: 16/783,537

(22) Filed: Feb. 6, 2020

(65) Prior Publication Data

US 2021/0003053 A1 Jan. 7, 2021

(30) Foreign Application Priority Data

Jul. 2, 2019 (TW) ..... 108123246

(51) Int. Cl.
*F01N 1/02* (2006.01)
*F01N 1/08* (2006.01)
*F01N 1/04* (2006.01)

(52) U.S. Cl.
CPC ..... *F01N 1/085* (2013.01); *F01N 1/026* (2013.01); *F01N 1/04* (2013.01); *F01N 1/02* (2013.01); *F01N 2310/14* (2013.01); *F01N 2470/02* (2013.01); *F01N 2470/24* (2013.01); *F01N 2590/04* (2013.01)

(58) Field of Classification Search
CPC . F01N 1/026; F01N 1/085; F01N 1/24; F01N 2470/02; F01N 2470/24; F01N 2590/04
See application file for complete search history.

(56) References Cited

U.S. PATENT DOCUMENTS 3,688,870 A * 9/1972 Gibel ..... F01N 1/10 181/267
8,083,025 B2 * 12/2011 Murakami ..... F01N 1/24 181/249
2007/0151798 A1 * 7/2007 Smith ..... F01N 13/141 181/256
2008/0308347 A1 * 12/2008 Luttig ..... F01N 1/24 181/253

(Continued)

FOREIGN PATENT DOCUMENTS

EP 1442905 A2 * 8/2004 ..... F01N 1/084
KR 20090001701 U * 2/2009
TW M564637 U 8/2018

*Primary Examiner* — Jonathan R Matthias
(74) *Attorney, Agent, or Firm* — Karin L. Williams; Alan D. Kamrath; Mayer & Williams PC

(57) ABSTRACT

A muffler structure contains: a body, a first cover unit, and a second cover unit. The body includes an accommodation tube, fiber cotton, and a first mesh portion. The accommodation tube has an accommodating space and an internal fence. The first cover unit includes a manifold connection portion, a first polygonal cap, a hollowly tubular mesh having multiple orifices, a second mesh portion, and a stainless steel mesh. The second cover unit is fixed on a rear end of the accommodation tube of the body opposite to the first cover unit, and the second cover unit includes a second polygonal cap and a silencer. The second polygonal cap is covered on the accommodation tube of the body, and the second polygonal cap has a receiving portion defined in a free end thereof and configured to accommodate the silencer.

2 Claims, 6 Drawing Sheets

(56) References Cited

U.S. PATENT DOCUMENTS

2010/0213000 A1* 8/2010 Inoue ..... F01N 1/003
181/252
2012/0267191 A1* 10/2012 Danner ..... F01N 1/04
181/227

* cited by examiner

MUFFLER STRUCTURE

BACKGROUND OF THE INVENTION

Field of the Invention

The present invention is an exhaust pipe, and more particular to a muffler structure of a vehicle.

Description of the Prior Art

Land vehicles (such as automobiles and motorcycles) are popular transportation at present. They have engine configured to generate power to drive the vehicles after the fuels is burned. However, it exhausts gas and causes emitting the noises. Therefore, an exhaust pipe is arranged on the vehicle to exhaust the waste gas from the engine and offset some of shock waves to reduce the noises.

A conventional exhaust pipe contains an outer cylinder, an inner tube accommodated in the outer cylinder and having multiple orifices defined around the inner tube, noise absorption cotton filled between the outer cylinder and the inner tube, such that the exhaust gas flows through the inner tube and is inflated by ways of the multiple orifices to reduce exhaust pressure, and the noises are absorbed by the noise absorption cotton.

An exhaust pipe is disclosed in TW filing no. 107205165 and contains a body, a mesh tube, and noise absorption cotton. The mesh tube has a noise reducer configured to stop exhaust gas from an engine by ways semicircular cover of the noise reducer, and the exhaust gas is discharged out of an exhaust pipe from the multiple orifices via the inner tube to extend flowing time of the exhaust gas in the mesh tube.

However, the exhaust pipe cannot load the exhaust gas when the exhaust gas is discharged out of the noise reducer, then the exhaust gas with high temperature impacts the fiber cotton, the fiber cotton burns and melts in a high temperature. Thereafter, the fiber cotton produces crystals and linear fibers after being cooled, and the crystals hit the exhaust pipe after restarting the engine to cause the noises or the linear fibers spray out of the exhaust pipe.

Therefore, it is important to discharge the exhaust gas smoothly and to reduce the noises after the engine operates.

The present invention has arisen to mitigate and/or obviate the afore-described disadvantages.

SUMMARY OF THE INVENTION

The primary objective of the present invention is to provide a muffler structure by which when high-pressure exhaust gas flows to a body from an engine of a vehicle via a manifold connection portion, a hollowly tubular mesh and a silencer, a high-pressure exhaust gas is not discharged to external atmospheric because of its high pressure; in contrast, the high-pressure exhaust gas scatters to multiple orifices of the hollowly tubular mesh of a first cover unit so as to reduce to a first exhaust pressure, and the high-pressure exhaust gas is decreased to a second exhaust pressure after flowing to a third stop portion, then the high-pressure exhaust gas is guided to an accommodating space of an accommodation tube of the body so as to be reduced to a third exhaust pressure by a buffer space; thereafter, the high-pressure exhaust gas is decreased to a minimum exhaust pressure less than the first, second, and third exhaust pressures by a first stop portion, thus buffering the high-pressure exhaust gas in the body of the muffler structure and reducing noises.

To achieve above-mentioned objectives, a muffler structure provided by the present invention contains: a body, a first cover unit, and a second cover unit.

The body is made of carbon fibers and includes an accommodation tube, fiber cotton, and a first mesh portion. The accommodation tube has an accommodating space and an internal fence which are defined in the accommodation tube, a cross-section of a front end of the accommodation tube is less than a cross-section of a rear end of the accommodation tube, and the accommodating space is configured to accommodate the fiber cotton and the first mesh portion which abut against the internal fence. The accommodating space of the accommodation tube of the body has a buffer space, and a first stop portion is defined by the fiber cotton and the first mesh portion.

The first cover unit includes a hollowly tubular mesh having multiple orifices and accommodated in the accommodation tube of the body. The first cover unit is covered by a second mesh portion and a stainless steel mesh.

The second cover unit is fixed on the rear end of the accommodation tube of the body opposite to the first cover unit.

DETAILED DESCRIPTION OF THE PREFERRED EMBODIMENTS

Figure 1:
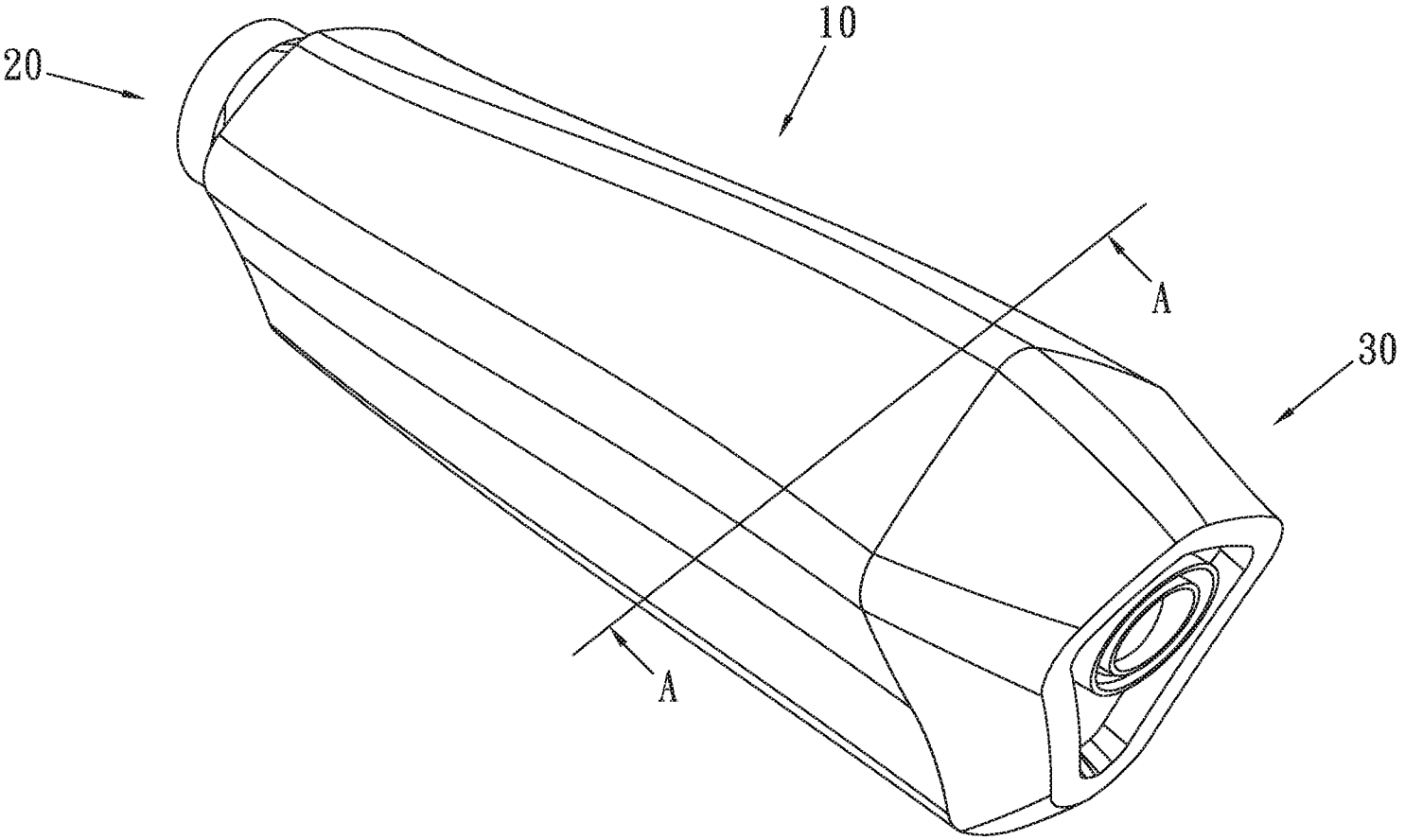
FIG. 1 is a perspective view showing the assembly of a muffler structure according to a preferred embodiment of the present invention.
Figure 2:
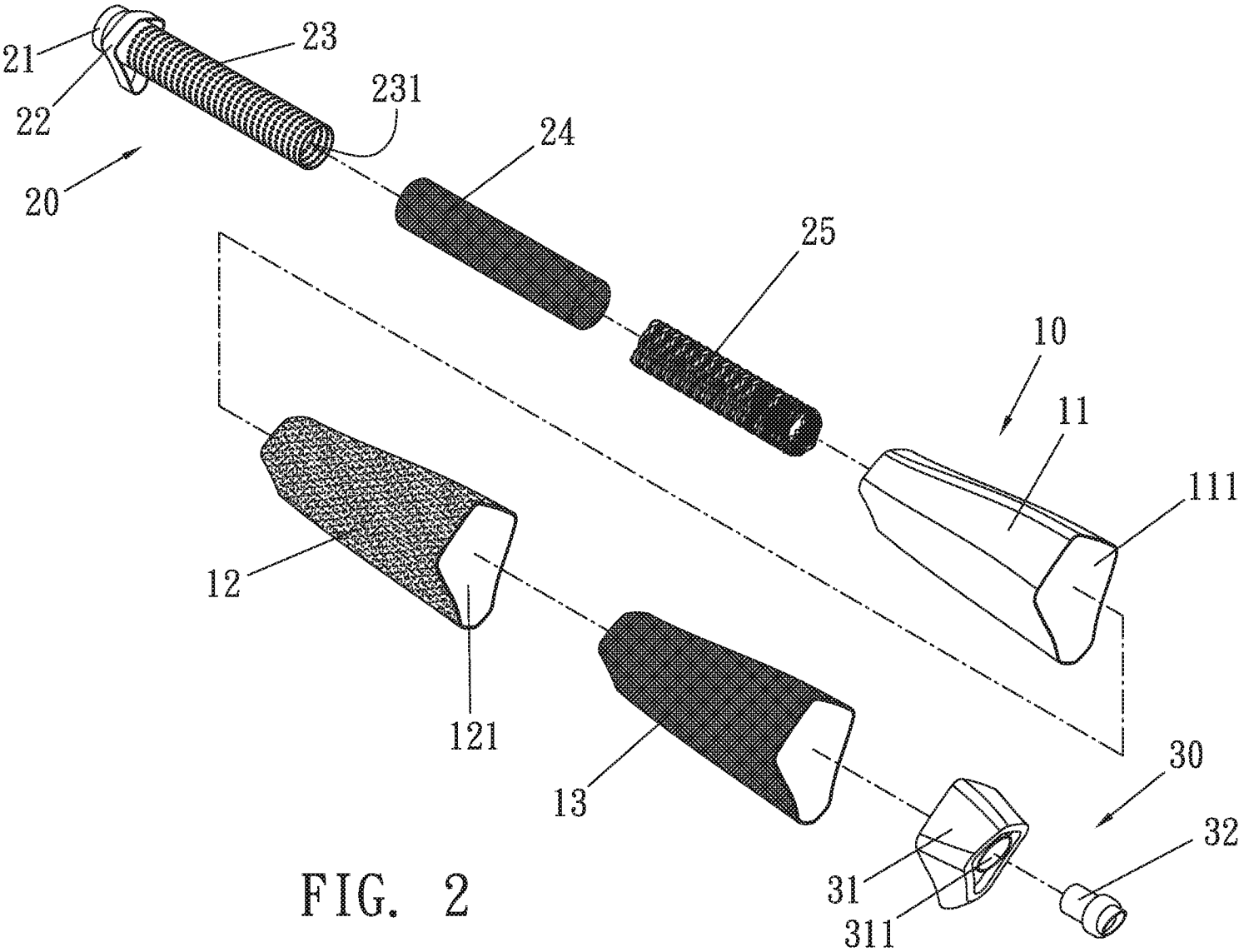
FIG. 2 is a perspective view showing the exploded components of the muffler structure according to the preferred embodiment of the present invention.
Figure 3:
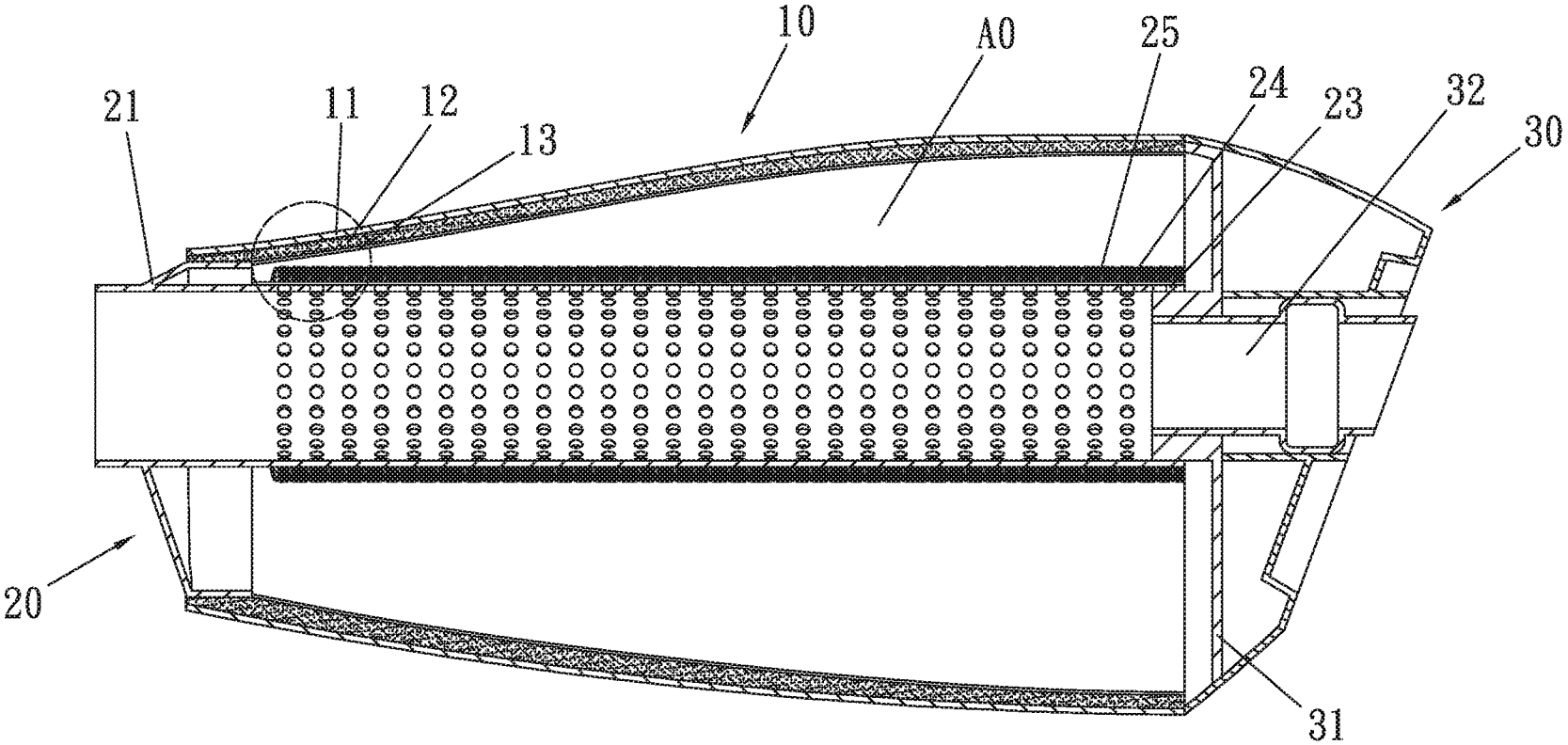
FIG. 3 is a cross sectional view showing the assembly of the muffler structure according to the preferred embodiment of the present invention.
Figure 4:
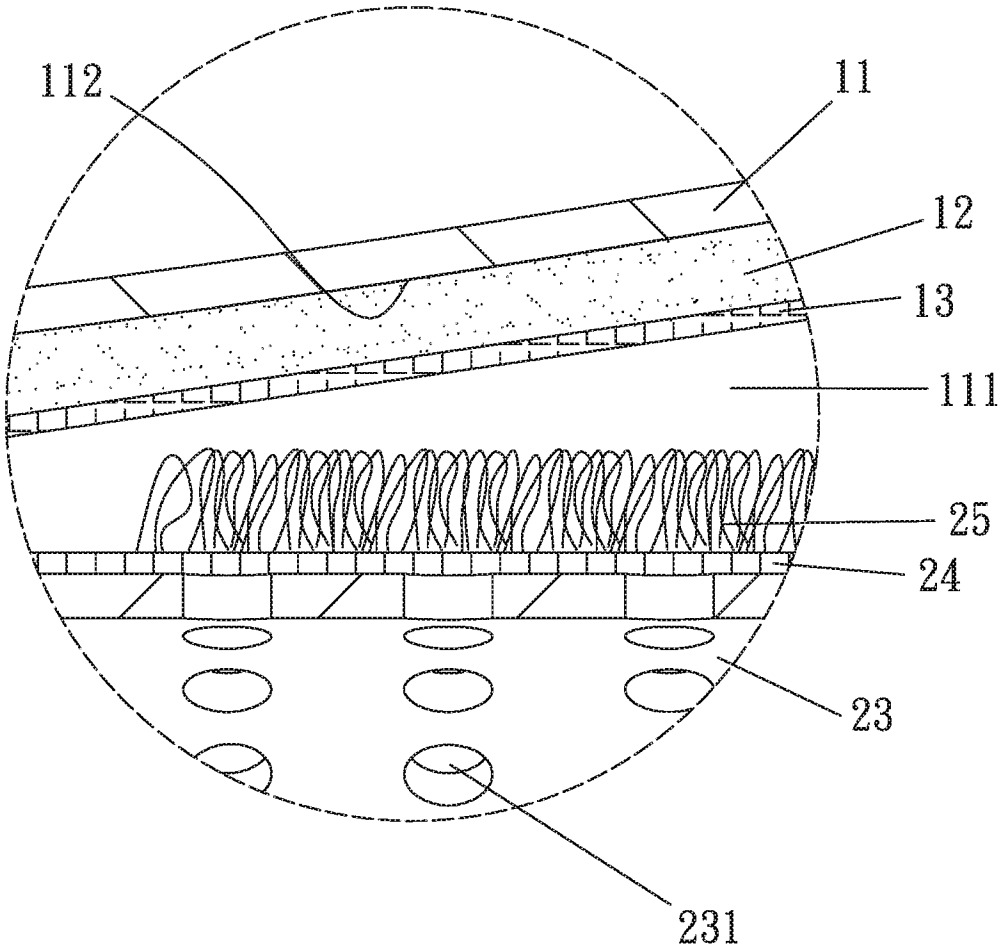
FIG. 4 is a cross sectional view showing the assembly of a part of the muffler structure according to the preferred embodiment of the present invention.

The present invention will be clearer from the following description when viewed together with the accompanying drawings, which show, for purpose of illustrations only, a preferred embodiment in accordance with the present invention.

With reference to FIGS. 1-6, a muffler structure according to a preferred embodiment of the present invention comprises:

a body 10 made of carbon fibers and including an accommodation tube 11, fiber cotton 12, and a first mesh portion 13, wherein the accommodation tube 11 has an accommodating space 111 and an internal fence 112 which are defined in the accommodation tube 11, and a cross-section of a front end of the accommodation tube 11 is less than a cross-section of a rear end of the accommodation tube 11, the accommodating space 111 is configured to accommodate the fiber cotton 12 and the first mesh portion 13 which abut against the internal fence 12;

a first cover unit 20 inserted into the accommodation tube 11 of the body 10 from the front end of the accommodation tube 11 to the rear end of the accommodation tube 11, wherein the first cover unit 20 includes a manifold connection portion 21, a first polygonal cap 22, a hollowly tubular mesh 23 having multiple orifices 231, a second mesh portion 24, and a stainless steel mesh 25, wherein a first end of the manifold connection portion 21 is connected with an engine, and a second end of the manifold connection portion 21 is connected with the first polygonal cap 22, the manifold connection portion 21 is one-piece formed with the first polygonal cap 22 and the hollowly tubular mesh 23, the first polygonal cap 22 is covered on the front end of the accommodation tube 11 of the body 10, the hollowly tubular mesh 23 is accommodated in the accommodating space 111 of the accommodation tube 11 of the body 10 and is covered by the second mesh portion 24 and the stainless steel mesh 25; and a second cover unit 30 fixed on the rear end of the accommodation tube 11 of the body 10 opposite to the first cover unit 20, wherein the second cover unit 30 includes a second polygonal cap 31 and a silencer 32, the second polygonal cap 31 is covered on the accommodation tube 11 of the body 10, and the second polygonal cap 31 has a receiving portion 311 defined in a free end thereof and configured to accommodate the silencer 32.

The first cover unit 20 is mounted on the front end of the accommodation tube 11 of the body 10, and the second cover unit 30 is fixed on the rear end of the accommodation tube 11 of the body 10 so that the accommodating space 111 of the accommodation tube 11 is closed, wherein the manifold connection portion 21 is in communication with the hollowly tubular mesh 23 and the silencer 32 to form an exhaust chamber A0. The accommodating space 111 of the accommodation tube 11 of the body 10 has a buffer space B defined from the hollowly tubular mesh 23 to the first mesh portion 13 of the accommodation tube 11 of the body 10, a first stop portion D defined by the fiber cotton 12 and the first mesh portion 13, a second stop portion E defined by the multiple orifices 231 of the hollowly tubular mesh 23 of the first cover unit 20, and a third stop portion F defined by the second mesh portion 24 and the stainless steel mesh 25.

Figure 5:
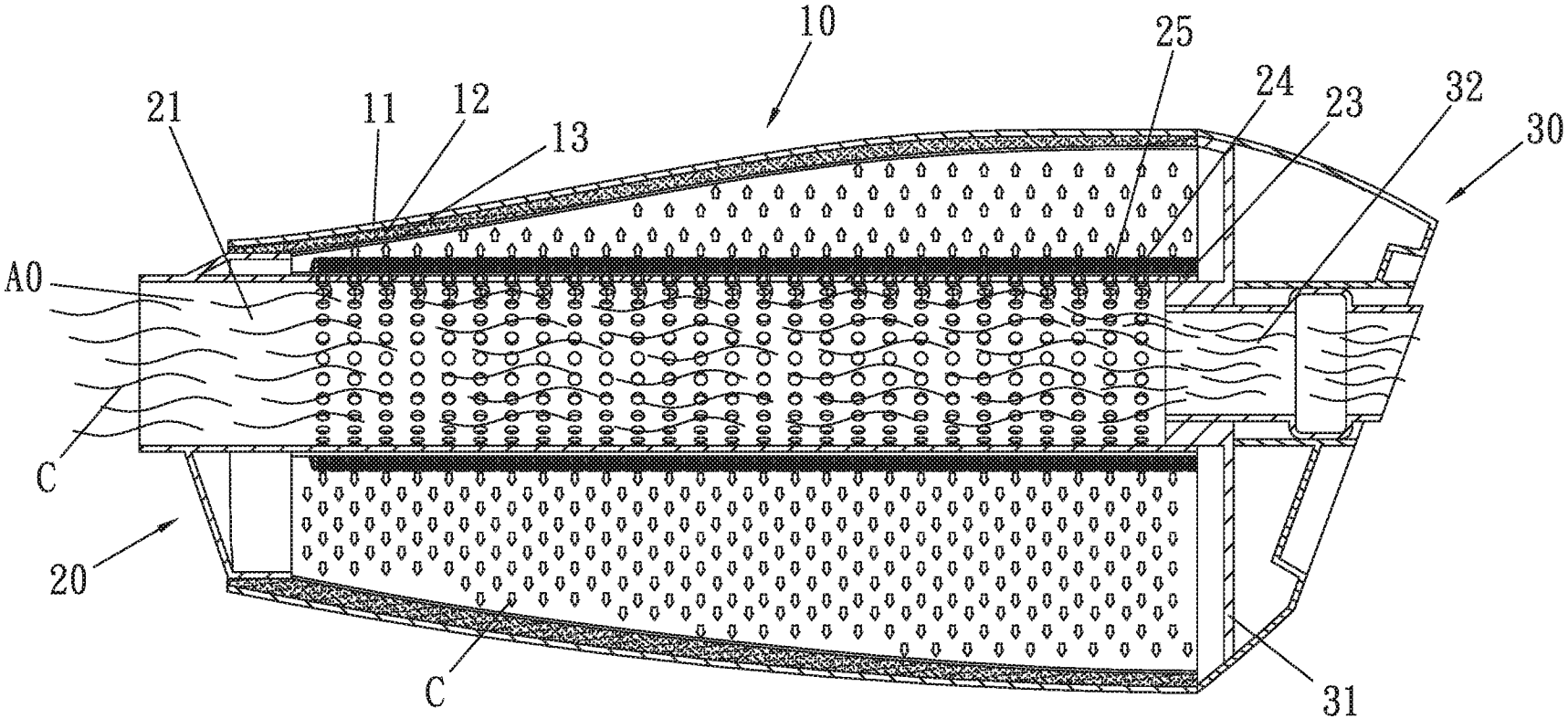
FIG. 5 is a cross sectional view showing the operation of the muffler structure according to the preferred embodiment of the present invention.
Figure 6:
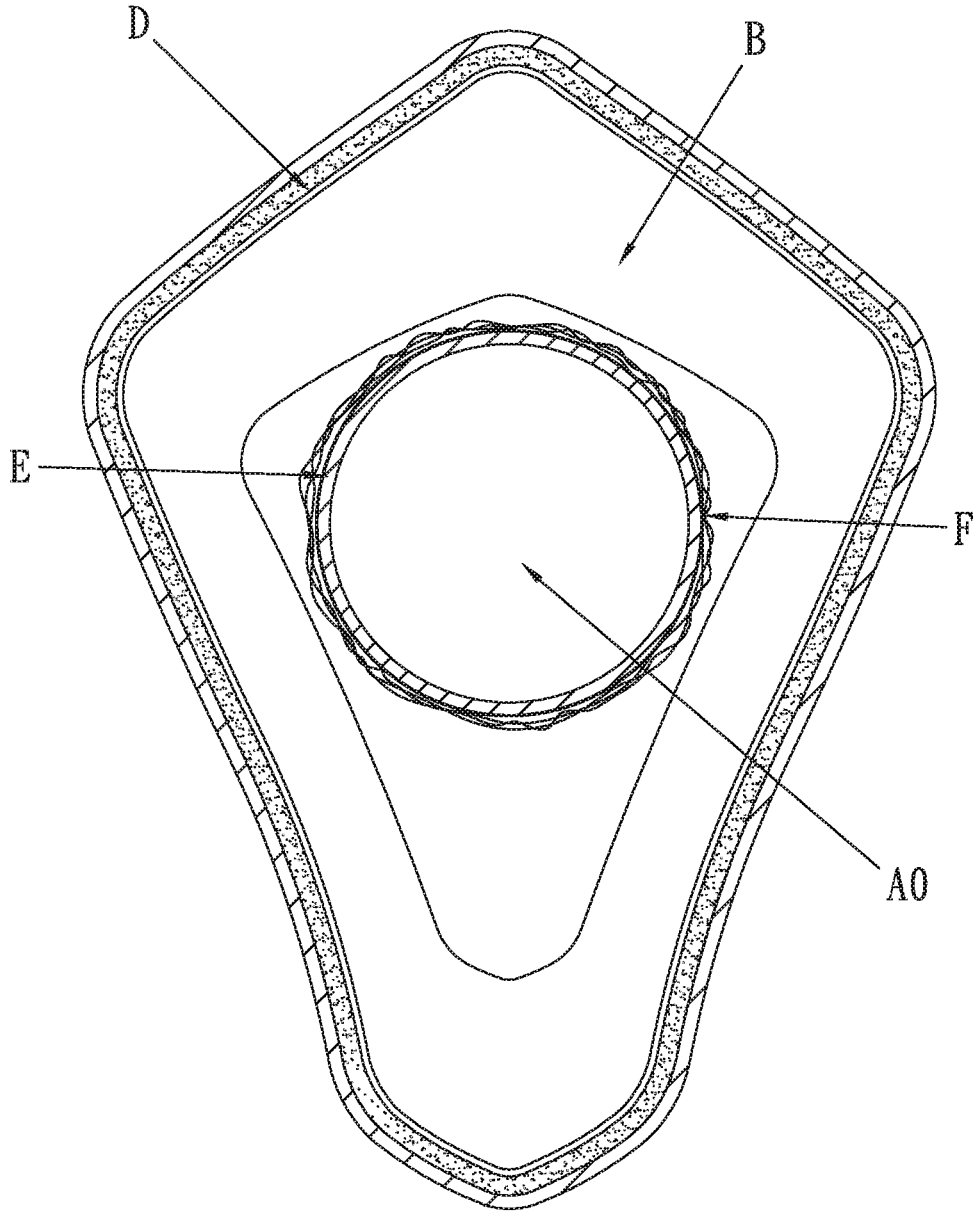
FIG. 6 is a cross sectional view taken along the line A-A of FIG. 1.

Referring to FIG. 5, when high-pressure exhaust gas C flows to the body 10 from the engine of a vehicle via the manifold connection portion 21, the hollowly tubular mesh 23, and the silencer 32, it is not discharged to external atmospheric because of its high pressure. In contrast, the high-pressure exhaust gas C scatters to the multiple orifices 231 of the hollowly tubular mesh 23 of the first cover unit 20 so as to reduce to a first exhaust pressure, and the high-pressure exhaust gas C is decreased to a second exhaust pressure after flowing to the third stop portion F, then the high-pressure exhaust gas C is guided to the accommodating space 111 of the accommodation tube 11 of the body 10 so as to be reduced to a third pressure exhausting by the buffer space B. Thereafter, the high-pressure exhaust gas C is decreased to a minimum exhaust pressure less than the first, second, and third exhaust pressures by the first stop portion D, thus buffering the high-pressure exhaust gas C in the body 10 of the muffler structure and reducing noises.

Accordingly, the muffler structure of the present invention buffers, scatters, and reduces the high-pressure exhaust gas by using the buffer space B, the first stop portion D, the second stop portion E, and the third stop portion F which are defined by the body 10, the first cover unit 20, the second cover unit 30, thus protecting an exhaust pipe of the vehicle and reducing the noises.

While various embodiments in accordance with the present invention have been shown and described, it is clear to those skilled in the art that further embodiments may be made without departing from the scope of the present invention.

What is claimed is:

1. A muffler structure comprising:

a body made of carbon fibers and including an accommodation tube, fiber cotton, and a first mesh portion, wherein the accommodation tube has an accommodating space and an internal fence which are defined in the accommodation tube, and a cross-section of a front end of the accommodation tube is less than a cross-section of a rear end of the accommodation tube, the accommodating space is configured to accommodate the fiber cotton and the first mesh portion which abut against the internal fence;

a first cover unit inserted into the accommodation tube of the body from the front end of the accommodation tube to the rear end of the accommodation tube, wherein the first cover unit includes a manifold connection portion, a first polygonal cap, a hollowly tubular mesh having multiple orifices, a second mesh portion, and a stainless steel mesh, wherein a first end of the manifold connection portion is connected with an engine, and a second end of the manifold connection portion is connected with the first polygonal cap, the manifold connection portion is one-piece formed with the first polygonal cap and the hollowly tubular mesh, the first polygonal cap is covered on the front end of the accommodation tube of the body, the hollowly tubular mesh is accommodated in the accommodating space of the accommodation tube of the body and is covered by the second mesh portion and the stainless steel mesh; and a second cover unit fixed on the rear end of the accommodation tube of the body opposite to the first cover unit, wherein the second cover unit includes a second polygonal cap and a silencer, the second polygonal cap is covered on the accommodation tube of the body, and the second polygonal cap has a receiving portion defined in a free end thereof and configured to accommodate the silencer;

wherein the first cover unit is mounted on the front end of the accommodation tube of the body, and the second cover unit is fixed on the rear end of the accommodation tube of the body so that the accommodating space of the accommodation tube is closed, wherein the manifold connection portion is in communication with the hollowly tubular mesh and the silencer to form an exhaust chamber; the accommodating space of the accommodation tube of the body has a buffer space defined from the hollowly tubular mesh to the first mesh portion of the accommodation tube of the body, a first stop portion defined by the fiber cotton and the first mesh portion, a second stop portion defined by the multiple orifices of the hollowly tubular mesh of the first cover unit, and a third stop portion defined by the second mesh portion and the stainless steel mesh.

2. The muffler structure as claimed in claim 1, wherein when high-pressure exhaust gas flows to the body from the engine of a vehicle via the manifold connection portion, the hollowly tubular mesh, and the silencer, the high-pressure exhaust gas is not discharged to external atmospheric because of its high pressure; in contrast, the high-pressure exhaust gas scatters to the multiple orifices of the hollowly tubular mesh of the first cover unit so as to reduce to a first exhaust pressure, and the high-pressure exhaust gas is decreased to a second exhaust pressure after flowing to the third stop portion, then the high-pressure exhaust gas is guided to the accommodating space of the accommodation tube of the body so as to be reduced to a third exhaust pressure by the buffer space; thereafter, the high-pressure exhaust gas is decreased to a minimum exhaust pressure less than the first, second, and third exhaust pressures by the first stop portion, thus buffering the high-pressure exhaust gas in the body of the muffler structure and reducing noises.

* * * * *